US007036895B2

(12) United States Patent
Han

(10) Patent No.: US 7,036,895 B2
(45) Date of Patent: May 2, 2006

(54) DEVICE TO LOCK THE COVER OF A DOOR SHELF OF A REFRIGERATOR

(75) Inventor: Jae-Myeong Han, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 163 days.

(21) Appl. No.: 10/303,700

(22) Filed: Nov. 26, 2002

(65) Prior Publication Data

US 2004/0004421 A1 Jan. 8, 2004

(30) Foreign Application Priority Data

Jul. 8, 2002 (KR) ..... 2002-39195

(51) Int. Cl.
*A47B 96/04* (2006.01)

(52) U.S. Cl. ..... 312/404; 312/405.1; 292/DIG. 72

(58) Field of Classification Search ..... 312/404, 312/405, 405.1; 292/146 X, 147, DIG. 15, 292/DIG. 16, DIG. 28, DIG. 38, DIG. 71 X; 24/662, 108

See application file for complete search history.

(56) References Cited

U.S. PATENT DOCUMENTS

| | | | | |
|---|---|---|---|---|
| 2,847,240 | A * | 8/1958 | Stone et al. | 292/70 |
| 2,933,794 | A * | 4/1960 | Biesecker | 411/15 |
| 4,917,413 | A * | 4/1990 | Jason et al. | 292/76 |
| 5,437,503 | A * | 8/1995 | Baker et al. | 312/404 |
| 5,628,533 | A * | 5/1997 | Hill | 292/80 |

FOREIGN PATENT DOCUMENTS

| | | |
|---|---|---|
| KR | 10-0220735 | 6/1999 |
| KR | 20-0267213 | 2/2002 |

* cited by examiner

*Primary Examiner*—Anthony D. Barfield
(74) *Attorney, Agent, or Firm*—Staas & Halsey LLP

(57) ABSTRACT

A device to lock a cover of a door shelf of a refrigerator. The door shelf has a main body and a cover hinged to the main body in such a way as to selectively open the main body. The device includes a seating unit and a projection. The seating unit has a seat and elastically engages with the projection to provide an improved engagement between the cover and the main body of the door shelf.

24 Claims, 7 Drawing Sheets

DEVICE TO LOCK THE COVER OF A DOOR SHELF OF A REFRIGERATOR

CROSS-REFERENCE TO RELATED APPLICATIONS

This application claims the benefit of Korean Application No. 2002-39195, filed Jul. 8, 2002, in the Korean Intellectual Property Office, the disclosure of which is incorporated herein by reference.

BACKGROUND OF THE INVENTION

1. Field of the Invention

The present invention relates generally to a door shelf of a refrigerator, and more particularly, to a device to lock a cover hinged to a main body of the door shelf in such a way as to selectively open the main body.

2. Description of the Prior Art

As well known to those skilled in the art, a refrigerator is an appliance intended to store various kinds of food for a lengthy period of time by a refrigerating cycle using a refrigerant. Generally, the refrigerator has a freezer compartment and a refrigerator compartment. The freezer compartment is used to freeze and store food, which has to be preserved for a lengthy period of time. On the other hand, the refrigerator compartment is used to store food for a short period of time without freezing the food, and is used to maintain the freshness of the food while preventing the food from spoiling. Typically, the freezer compartment is placed on the upper portion of the refrigerator while the refrigerator compartment is placed on the lower portion thereof. However, recently there has been proposed a large-capacity refrigerator which is designed to provide on its left side a freezer compartment and on its right side a refrigerator compartment. Further, such a large-capacity refrigerator is provided on its storage door a home bar-type shelf door to open and close a door shelf without opening and closing the storage door, thus reducing the waste of electricity caused by the escape of cold air from the refrigerator compartment due to frequent opening of the storage door. A conventional refrigerator will now be described with reference to FIGS. 1 to 3.

FIG. 1 is a front view of a conventional refrigerator which is now widely used. The refrigerator 100 is provided on its right side with a refrigerator compartment. A storage door 101 is provided at the refrigerator compartment to selectively open the refrigerator compartment. A freezer compartment 102 is provided on the left side of the refrigerator 100, and has a freezer door 102 to selectively open the freezer compartment 102. A water dispenser 104 and an ice dispenser 103 are provided on the outer wall of the freezer door 102 to supply cool water and ice to the user. The storage door 101 of the refrigerator 100 has a recessed portion to define a chamber. In this case, the chamber communicates with a door shelf. A shelf door 105 is provided on the outer wall of the storage door 101 to allow a user outside the refrigerator 100 to access the chamber. The door shelf will be described in detail with reference to FIGS. 2 and 3.

FIG. 2 shows a door shelf 200 mounted to the storage door 101 inside of the refrigerator 100. The chamber is defined by the storage door 101 and the door shelf 200. As described above, the chamber may be opened and closed by the shelf door 105 provided on the outer wall of the storage door 101 from the outside of the refrigerator 100. In addition, the chamber may be opened or closed by a cover 202 from the inside wall of the storage door 101. The chamber stores beverages or potable water which is frequently drunk. In this case, it is possible to easily access the beverages stored in the chamber through the shelf door 105, thus minimizing the loss of electricity caused by the escape of cool air from the refrigerator compartment. The cover 202, hinged to a main body 201 of the door shelf 200, is provided on the inside wall of the storage door 101 to open the chamber from the inside wall of the storage door 101, thus allowing a user to replenish the chamber with beverages. As shown in FIG. 3, in order to lock the cover 202 to the main body 201 when the cover 202 is closed, the cover 202 and the main body 201 are provided with a device to lock the cover while allowing the cover to be selectively opened. Generally, there has been proposed a conventional device to lock a cover using hook units 301*a* and 301*b*.

However, the conventional device to lock the cover of the refrigerator's door shelf has a problem in that it makes a big noise, due to the hook units, when closing the cover. The conventional device has another problem in that the cover may be damaged according to the intensity of a force applied thereto when closing the cover, because the main body comes into direct contact with the cover. The conventional device has a further problem in that the cover is not completely closed but may be instantaneously and resiliently opened due to impact energy generated when closing the cover. Furthermore, the conventional device has a still further problem in that the cover is not completely locked to the main body, but is slightly spaced from the main body in the case where the force to close the cover is weak, so that the cover may undesirably swing when opening and closing the storage door.

SUMMARY OF THE INVENTION

Accordingly, it is an object of the present invention to provide a device to lock a cover of a door shelf of a refrigerator, which reduces noise when opening and closing the cover, and which absorbs impact energy generated when closing the cover, thus reducing impact energy applied to the cover or the main body of the door shelf, and which prevents the cover from being undesirably spaced from the main body.

Additional objects and advantages of the invention will be set forth in part in the description which follows and, in part, will be obvious from the description, or may be learned by practice of the invention.

The foregoing and/or other objects of the present invention are achieved by providing a device to lock a cover of a door shelf of a refrigerator, the door shelf having a main body and a cover hinged to the main body in such a way as to selectively open the main body from the inside of the refrigerator, the device comprising: a seating unit having a seat and provided on the main body; and a projection provided on the cover, wherein the seat is made of an elastic material to elastically engage with the projection, or the device comprising a seating unit having a seat and provided on the main body, and a projection provided on the cover, wherein the projection is made of an elastic material to elastically engage with the seat.

In another aspect of this invention, the device comprises a seating unit having a seat and provided on the cover, and a projection provided on the main body, wherein the seat is made of an elastic material to elastically engage with the projection. Alternatively, the device may comprise a seating unit having a seat and provided on the cover, and a projection provided on the main body, wherein the projection is made of an elastic material to elastically engage with the seat.

BRIEF DESCRIPTION OF THE DRAWINGS

These and other objects and advantages of the invention will become apparent and more readily appreciated from the following description of the embodiments, taken in conjunction with the accompanying drawings of which.

DESCRIPTION OF THE PREFERRED EMBODIMENTS

Figure 1:
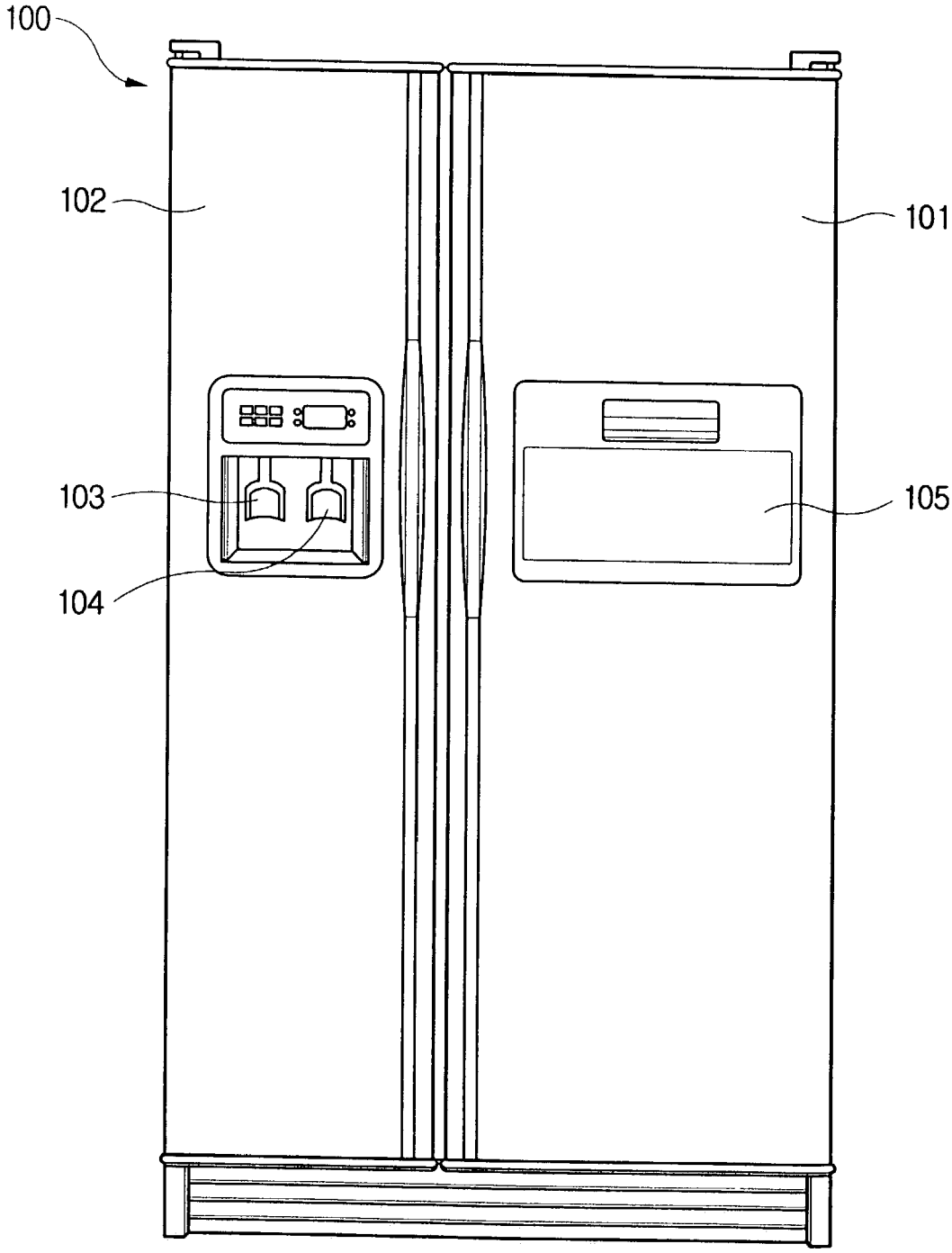
FIG. 1 is a front view showing a conventional refrigerator.
Figure 2:
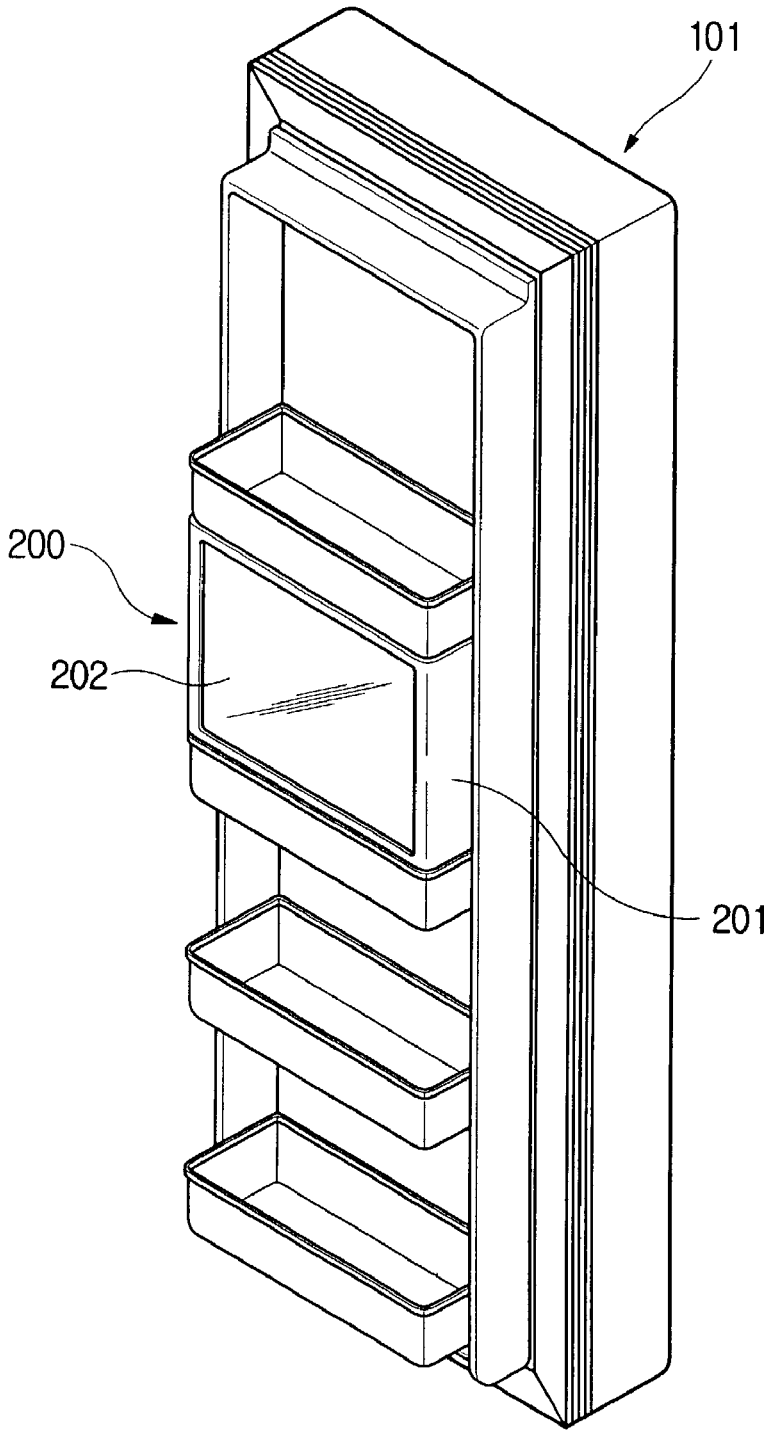
FIG. 2 is a perspective view of a storage door shown from inside the refrigerator.
Figure 3:
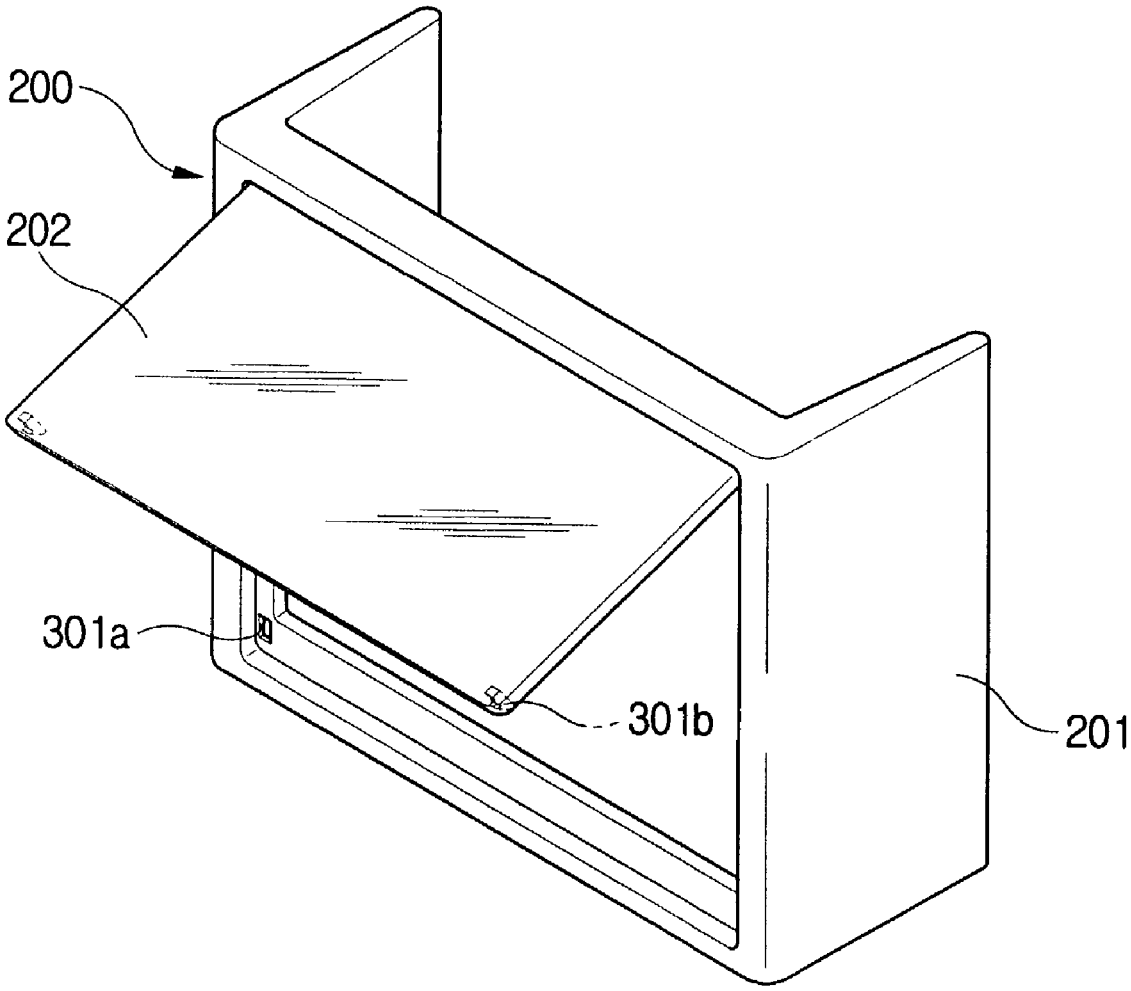
FIG. 3 is a perspective view of a conventional door shelf included in the refrigerator.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 4:
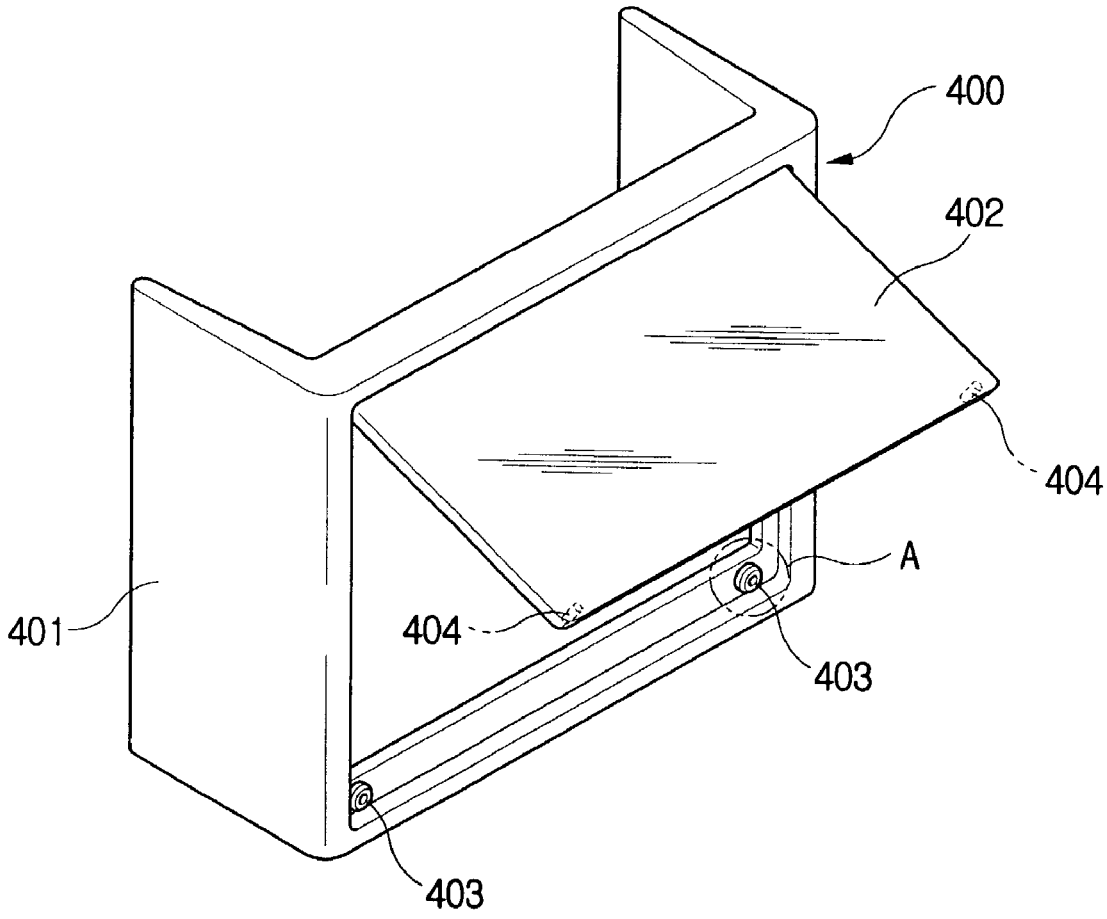
FIG. 4 is a perspective view of a door shelf according to an embodiment of this invention.

FIG. 4 is a perspective view of a door shelf of a refrigerator having a device to lock a cover according to this invention. A cover 402 is hinged to a main body 401 in such a way as to be vertically opened and closed. Two seating units 403 are provided on both the right and left sides at the lower portion of the main body 401, respectively. The cover 402 is provided on both the right and left sides at its lower portion with two projections 404 corresponding to the seating units 403. By such a construction, the projections 404 provided on the cover 402 are fitted into and seated on seats 403*a* of the seating units 403 provided on the main body 401, such that the cover 402 is locked to the main body 401. The projections 404 and the seating units 403 will be described in detail with reference to FIGS. 5 and 6A–6B.

Figure 5:
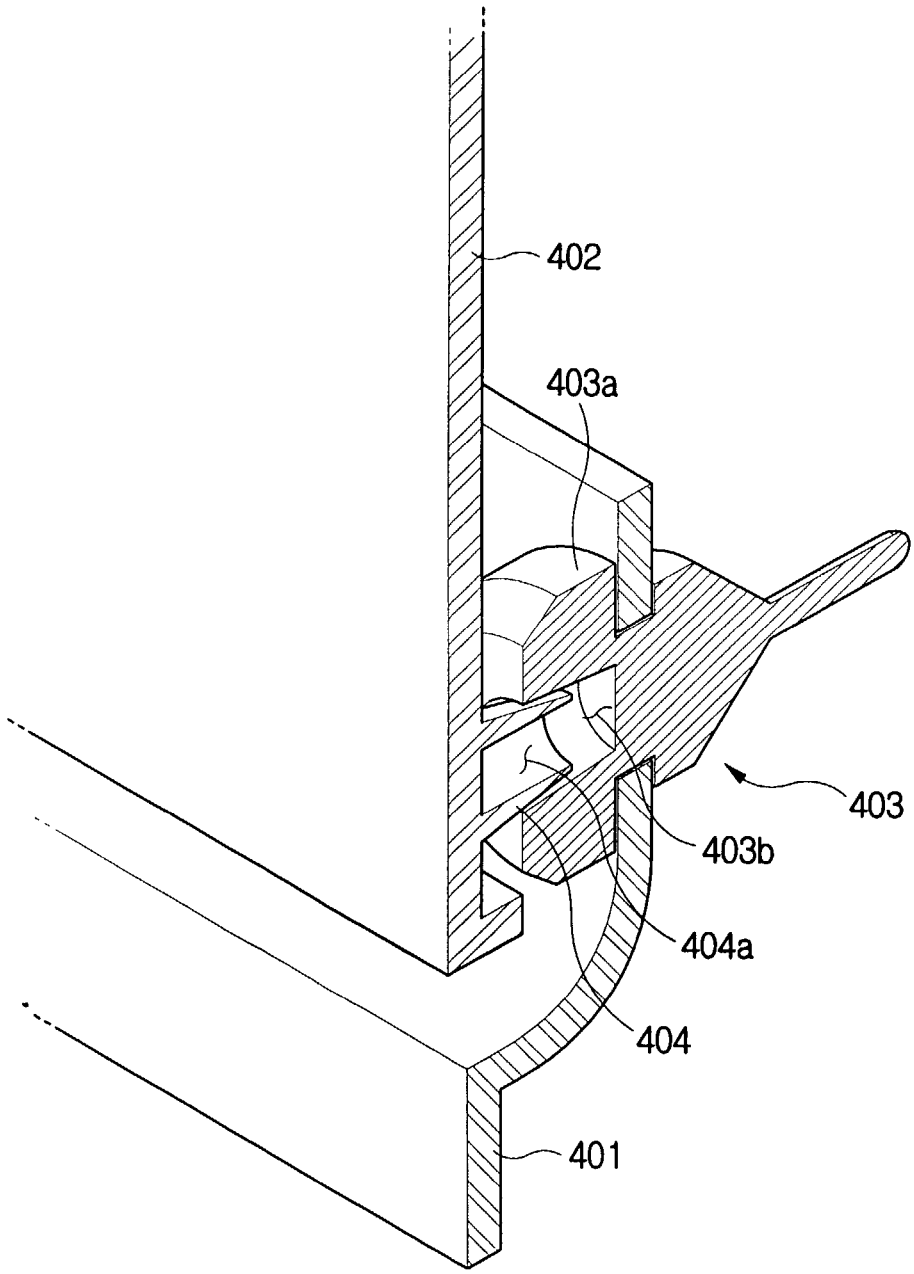
FIG. 5 is an enlarged view of the part "A" encircled in FIG. 4, that is, a perspective view showing a device to lock a cover of a door shelf of a refrigerator in accordance with the embodiment of FIG. 4.

FIG. 5 is an enlarged perspective view of the part "A" encircled in FIG. 4, and shows the projections 404 provided on the cover 402 and the seating units 403 provided on the main body 401 in accordance with the present invention. As shown in the drawing, an air channel 404*a* is axially formed along each projection 404. Each of the seating units 403 has on its seat 403*a* a seating groove 403*b* corresponding to each projection 404. In this case, each of the projections 404 is seated on the corresponding seat 403*a*. It is preferable that either the projections 404 or the seats 403*a* are made of an elastic material. When the projections 404 are seated on the corresponding seats 403*a*, a force to hold the engagement of the projections 404 and the seats 403*a* is required. In order to obtain such a holding force, the projections 404 and the seating grooves 403*b* are designed such that the outer diameters of the projections 404 are slightly larger than the inner diameters of the seating grooves 403*b*. In this case, it is possible for the projections 404 to constrict in a radial direction, or for the seating grooves 403*b* to elastically expand in a radial direction, such that the projections 404 elastically engage with the corresponding seating grooves 403*b*. It is an aspect that the seats 403*a* are made of an elastic material, and that the projections 404 provided on the hard cover 402 are made of a hard material, in order that the projections 404 are easily fitted into the seating grooves 403*b*. It is another aspect that silicone is used as the elastic material, because silicone has a long useful life span and excellent elasticity. However, other materials that provide the required elasticity may also be used.

Further, it is an aspect that the projections 404 or the seats 403*a* are made of an elastic material as described above, so that they serve to absorb impact energy generated when closing the cover 402.

The function of the air channels 404*a* formed on the projections 404 and the seating grooves 403*b* will now be described.

When an external force is exerted on the cover 402 to close it, air is fed into the air channels 404*a*. At the same time, air is fed into the seating grooves 403*b*. As soon as the cover 402 is closed, that is, each projection 404 is primarily inserted into the corresponding seating groove 403*b* by a certain depth, the projection 404 elastically engages with the corresponding seating groove 403*a*, so the air channel 404*a* defines a sealing space along with the seating groove 403*b*. Air in the sealing space generates a reverse force against the external force which is required to close the cover 402. Thus, although a large external force is exerted on the cover 402, the reverse force of a magnitude which is proportional to the external force is instantaneously generated by air offsetting the external force, thus reducing impact energy when closing the cover 402. Of course, when the external force is further applied to the cover 402, air escapes from the sealing space formed by the elastic engagement of the projections 404 with the corresponding seating units 403*a*, so the cover 402 is completely closed without any difficulty.

Figure 6A:
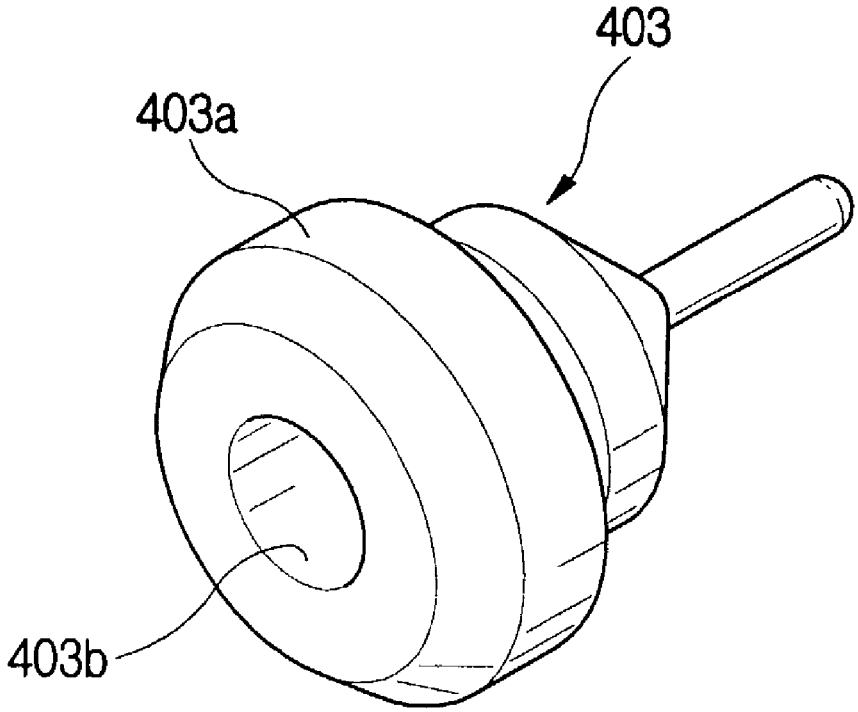
FIGS. 6A and 6B are perspective views of seating units, respectively, included in the cover locking device according to FIG. 5.

FIG. 6A is a perspective view of the seating unit 403 shown in FIG. 5. The seat 403*a* and the seating groove 403*b* are shown in FIG. 6A in detail, and will not be described in the following in detail.

Figure 6B:
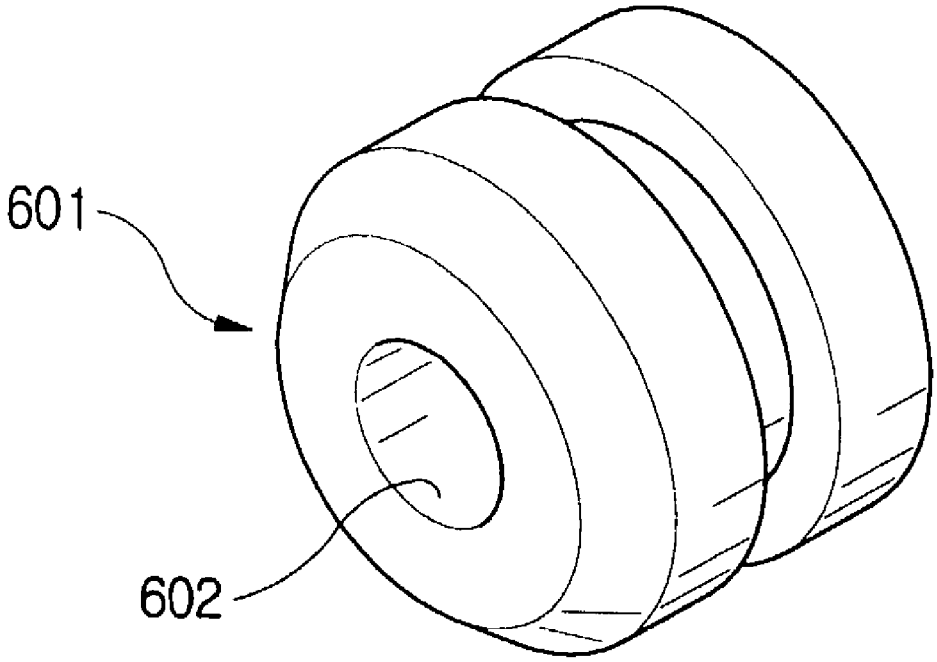

FIG. 6B shows a seating unit according to a modification of FIG. 6A. As shown in FIG. 6B, the seating unit 601 is not provided with the seating groove 403*b* which is closed at its interior but with a seating hole 602 which is inwardly opened. In this case, the seating units 601 doubly absorb impact energy generated when closing the cover 402. That is, the projections or the seats made of an elastic material may absorb, using their elastic force, impact energy generated when closing the cover 402. In addition, the seating unit 601 has a sealing space containing air, thus absorbing the impact energy using the reverse force produced by the air. It is thus apparent that the seating unit of FIG. 6B absorbs more impact energy than that of FIG. 6A.

As described above, the present invention provides a device to lock a cover of a door shelf of a refrigerator, which is designed to have a predetermined elastic force due to its material and engaging structure and a reverse force produced by air, thus reducing impact energy and noise generated when closing the cover, therefore preventing the cover and/or main body of the door shelf from being damaged, and which is designed to elastically engage the cover with the main body, thus preventing the cover from being instantaneously and resiliently opened even when a large external force is exerted, therefore preventing the cover from being undesirably spaced from the main body.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A device to lock a cover of a door shelf of a refrigerator, the door shelf having a main body and a cover hinged to the main body to selectively open the main body from the inside of the refrigerator, said device comprising:

a seating unit having a seat and provided on the main body; and a projection projecting perpendicular to a face of the cover, said seat being made of an elastic material to elastically engage with the projection, wherein an air channel is axially provided within the projection.

2. The device according to claim 1, wherein said seat is provided with a seating groove corresponding to said projection.

3. The device according to claim 2, wherein an outer diameter of the projection is slightly larger than an inner diameter of the respective seating groove.

4. The device according to claim 3, wherein the projection constricts in a radial direction such that the projection elastically engages with the corresponding seating groove.

5. The device according to claim 3, wherein the seating groove elastically expands in a radial direction such that the projection elastically engages with the corresponding seating groove.

6. The device according to claim 1, wherein said seat is provided with a seating hole corresponding to said projection.

7. The device according to claim 1, wherein said elastic material comprises silicone.

8. The device according to claim 1, wherein the projection is made of a hard material.

9. The device according to claim 1, wherein said seat is provided with a seating groove corresponding to said projection such that the projection elastically engages with the seating groove.

10. The device according to claim 9, wherein the air channel defines a sealing space along with the seating groove.

11. The device according to claim 10, wherein air in the sealing space generates a reverse force against the external force which is required to close the cover such that the reverse force has a magnitude which is proportional to an external force and instantaneously generated by air offsetting the external force to reduce impact energy.

12. The device according to claim 11, wherein when further external force is applied to the cover, air escapes from a sealing space formed by the elastic engagement of the projection with the corresponding seating unit such that the cover is completely closed without difficulty.

13. A device to lock a cover of a door shelf of a refrigerator, the door shelf having a main body and a cover hinged to the main body to selectively open the main body from the inside of the refrigerator, said device comprising:

a seating unit having a seat and provided on the main body; and a projection projecting perpendicular to a face of the cover, said projection being made of an elastic material to elastically engage with the seat, wherein an air channel is axially provided within the projection.

14. The device according to claim 13, wherein said seat is provided with a seating groove corresponding to said projection.

15. The device according to claim 13, wherein said seat is provided with a seating hole corresponding to said projection.

16. The device according to claim 13, wherein said elastic material comprises silicone.

17. A device to lock a cover of a door shelf of a refrigerator, the door shelf having a main body and a cover hinged to the main body to selectively open the main body from the inside of the refrigerator, said device comprising:

a seating unit having a seat and provided on the cover; and a projection projecting perpendicular to a face of the main body, said seat being made of an elastic material to elastically engage with the projection, wherein an air channel is axially provided within the projection.

18. The device according to claim 17, wherein said seat is provided with a seating groove corresponding to said projection.

19. The device according to claim 17, wherein said seat is provided with a seating hole corresponding to said projection.

20. The device according to claim 17, wherein said elastic material comprises silicone.

21. A device to lock a cover of a door shelf of a refrigerator, said door shelf having a main body and a cover hinged to the main body to selectively open the main body from the inside of the refrigerator, said device comprising:

a seating unit having a seat and provided on the cover; and a projection projecting perpendicular to a face of the main body, said projection being made of an elastic material to elastically engage with the seat, wherein an air channel is axially provided within the projection.

22. The device according to claim 21, wherein said seat is provided with a seating groove corresponding to said projection.

23. The device according to claim 21, wherein said seat is provided with a seating hole corresponding to said projection.

24. The device according to claim 21, wherein said elastic material comprises silicone.

* * * * *